US006330749B1

(12) United States Patent
Khachatoorian et al.

(10) Patent No.: US 6,330,749 B1
(45) Date of Patent: Dec. 18, 2001

(54) ADJUSTABLE SAFETY UTILITY KNIFE WITH EASILY REMOVABLE BLADE HOLDER

(75) Inventors: Zareh Khachatoorian, Northridge, CA (US); Jian Ping Qiu, Hangzhou (CN)

(73) Assignee: Olympia Group, Inc., City of Industry, CA (US)

( * ) Notice: Subject to any disclaimer, the term of this patent is extended or adjusted under 35 U.S.C. 154(b) by 0 days.

(21) Appl. No.: 09/374,524

(22) Filed: Aug. 14, 1999

(51) Int. Cl.[7] ..... B26B 1/08; B26B 1/10
(52) U.S. Cl. ..... 30/162; 30/125; 30/335
(58) Field of Search ..... 30/125, 162, 335, 30/340

(56) References Cited

U.S. PATENT DOCUMENTS 3,593,417 * 7/1971 West ..... 30/125
3,872,591 * 3/1975 Quenot ..... 30/125 X
5,727,320 * 3/1998 Shepherd ..... 30/125

* cited by examiner

*Primary Examiner*—Douglas D. Watts
(74) *Attorney, Agent, or Firm*—Lackenbach Siegel Marzullo Aronson & Greenspan, P.C.

(57) ABSTRACT

An adjustable safety utility knife includes an elongated ergonomically shaped handle formed of two elongate shell members each having a peripheral edge and an outer generally convex surface and an inner generally concave surface. The shell members are fastened at the peripheral edges along a vertical parting plane to form an elongated internal cavity. The handle defines a front end, a back end and an intermediate portion suitable for being gripped by a user and also defining top and bottom surfaces extending along opposite sides of the shell members along said peripheral edges. The handle has a slot-like aperture at the front end substantially aligned with the parting plane and dimensioned for passage of a flat cutting blade therethrough. A guide element within the elongated cavity guides the cutting blade between a first position for safely storing the blade fully inside said cavity and a second position for selectively extending the blade beyond the aperture to expose at least a portion thereof. A manually operated button arranged on the top surface is coupled to the guide element for selectively moving the blade between the first and second positions. The handle has a rear opening at the back end for providing access to the elongated internal cavity. A carrier frame has a blade cartridge receiving compartment and dimensioned to be removably receivable within the cavity through the rear opening between a retracted position in which the carrier frame is fully stored within the internal cavity of the handle end and an extended position in which the carrier frame is at least partially moved exteriorly of the back end to provide access of the cartridge receiving compartment. A blade cartridge for storing a plurality of flat cutting blades is receivable within the blade cartridge receiving compartment.

13 Claims, 3 Drawing Sheets

ADJUSTABLE SAFETY UTILITY KNIFE WITH EASILY REMOVABLE BLADE HOLDER

BACKGROUND OF THE INVENTION

1. Field of the Invention

The present invention generally relates to hand tools and, more specifically, to an adjustable safety utility knife with easily removable blade holder.

2. Description of the Prior Art

Utility knives are widely used in construction, business and hobby applications for cutting such materials as paperboard, wallboard, string and other objects. Commonly, such utility knives are in the form of an elongate hollow housing that can be gripped by the user along an intermediate portion thereof and into which there are placed trapezoidal flat cutting blades. The blades typically have a single cutting edge. The blade is typically slidably mounted between a retracted position within the housing and an extended position in which the cutting edge is at least partially exposed through a front end aperture or slot, the slot being coupled to a manually operated element, such as a button positioned in a manner convenient to be actuated by the user's hand.

Many utility knives include a region within the housing for storing one or two additional blades that can be used to replace the operative blade when it becomes dull. In most cases a screw or similar means is used for attaching the two clam shell members together during normal use. When blades are to be replaced, the screw is removed, allowing to two shell members to be separated, and access is provide to the replacement blades.

The flat cutting blades used in utility knives are most useful and are easiest to use when the blades are extremely sharp. These blades, therefore, are frequently replaced once they become dull. For this purpose, known utility knives provide storage within the handle for additional blades so that these will be readily available when needed. In order to facilitate this replacement procedure, some utility knives provide a blade holder which stores the plurality of blades and which can be quickly and conveniently removed from the utility knife handle. Examples of such holders are shown in U.S. Pat. Nos. 3,593,147; 3,872,591; 4,277,888; 4,761,882, 4,922,610; 5,005,290; 5,042,154; 5,386,632; 5,404,645; 5,604,984; 5,613,300; 5,644,843; and 5,727,320. However, these have the disadvantage that once the holder is removed from the handle, there is nothing to prevent one or more of the blades from falling out. However, because these blades have their edges exposed, this can create a hazardous condition for the user when one or more blades with exposed edges may need to be handled. See, for example, U.S. Pat. Nos. 3,593,417; 3,872,591; 5,386,632; 5,613,300; 5,644,843.

In U.S. Pat. No. 4,761,882, cutting blades are stored in a compartment at the rear of the handle housing, a transverse slot being provided in the handle for providing access to the replacement blades, which may be removed by pressing the exposed blade by a finger through the opening in the handle for removal of the blade through a slot at the rear of the handle. However, this utility knife requires that the storage compartment or magazine area be replenished by handling individual cutting blades and manual inserting them into the handle. Additionally, the provision of a relatively large finger opening exposes the interior of the handle cavity to exterior contaminants, including liquids, dust, etc., which may ultimately cause a deterioration of the internal operating components.

In U.S. Pat. No. 4,922,610, a blade holder having a magazine is disclosed in which the housing includes a slot the upper side thereof which allows a blade to be withdrawn by pivoting an operable device within the handle about a pivot in the blade magazine on which the respective blade is supported. However, with the disclosed blade removal device, only a small portion of the blade becomes exposed through the upper slot which may render the blade difficult to grasp and remove. Additionally, the angle at which the blade is positioned when in condition for removal such that it may contact other parts or components of the utility knife and, therefore, render removal more difficult or inconvenient.

In U.S. Pat. No. 5,404,645, a knife blade holder is disclosed in which the shell members are pivotally connected to each other to be movable in a scissors-like manner and a blade magazine is provided which can be inserted or withdrawn when the handles are pivoted relative to each other. However, when the handles are so pivoted, this also exposes the operative or active blade at the front end of the handle housing which can become dislodged and may need to be handled by the user.

Other utility knife designs are also known. Many of these use complex and costly constructions. For example, in U.S. Pat. Nos. 5,604,984 and 5,727,320, utility knives are shown with rotary blade magazines which substantially enlarged the back end of the utility knife handle and which make them less convenient to use. Additionally, the use of a rotary magazine requires a more complex construction, which significantly increases the cost of the unit.

SUMMARY OF THE INVENTION

Accordingly, it is an object of the present invention to provide an adjustable safety utility knife which does not have the disadvantages inherent in such prior art designs.

It is another object of the present invention to provide an adjustable safety utility knife which is simple in construction and economical to manufacture.

It is still another object of the present invention to provide an adjustable safety utility knife which has in its handle a blade magazine for replacement blades which may be easily and safely removed.

It is yet another object of the invention to provide an adjustable safety utility knife which prevents cutting blades from inadvertently being dislodged from the handle housing when a replacement blade is sought to be extracted or removed.

It is a further object of the invention to provide an adjustable safety utility knife which ensures that the user need only handle a single blade during blade replacement.

It is still a further object of the present invention to provide an adjustable safety utility knife which includes a removable replacement blade magazine without altering the external ergonomic shape of the handle housing.

It is yet a further object of the present invention to provide an adjustable safety utility knife as in the previous objects which provides a ready access to individual blades within an internal blade cartridge without exposing the interior of the housing.

In order to achieve the above objects, and others which will become apparent hereinafter, an adjustable safety utility knife in accordance with the present invention comprises an elongated ergonomically shaped handle formed of two elongate shell members, each having a peripheral edge and an outer convex surface and an inner generally concave surface.

Fastening means is provided for fastening such shell members at said peripheral edges along a vertical parting plane to form an elongated internal cavity. Said handle defines a front end, a back end and an intermediate portion suitable for being gripped by a user and also defining top and bottom surfaces extending along opposite sides of said front end substantially aligned with said parting plane and dimensioned for passage of a flat cutting blade therethrough. Guide means is provided within said elongated cavity for guiding the cutting blade between a first position for safely storing the blade fully inside said cavity and a second position for selectively extending the blade beyond said aperture to expose at least a portion thereof A manually operated button is arranged on said top surface and coupled to said guide means for selectively moving the blade between said first and second positions.

Said handle has a rear opening at said back end for providing access to said elongated internal cavity. A carrier frame is provided that has a blade cartridge receiving compartment and is dimensioned to be removably receivable within said cavity through said rear opening between a retracted position in which said carrier frame is fully stored within said internal cavity of said handle and an extended position in which said carrier frame is at least partially moved exteriorly of said back end to provide access to said cartridge receiving compartment. A blade cartridge is provided for storing a plurality of flat cutting blades receivable within said blade cartridge receiving compartment and being individually fully removable through a rear slot-like aperture in said carrier frame.

BRIEF DESCRIPTION OF THE DRAWINGS

Other aspects, objects and advantages of the present invention will become apparent upon reading of the following detailed description of a preferred embodiment of the present invention when taken in conjunction with the drawings, as follows.

DESCRIPTION OF A PREFERRED EMBODIMENT

Figure 1:
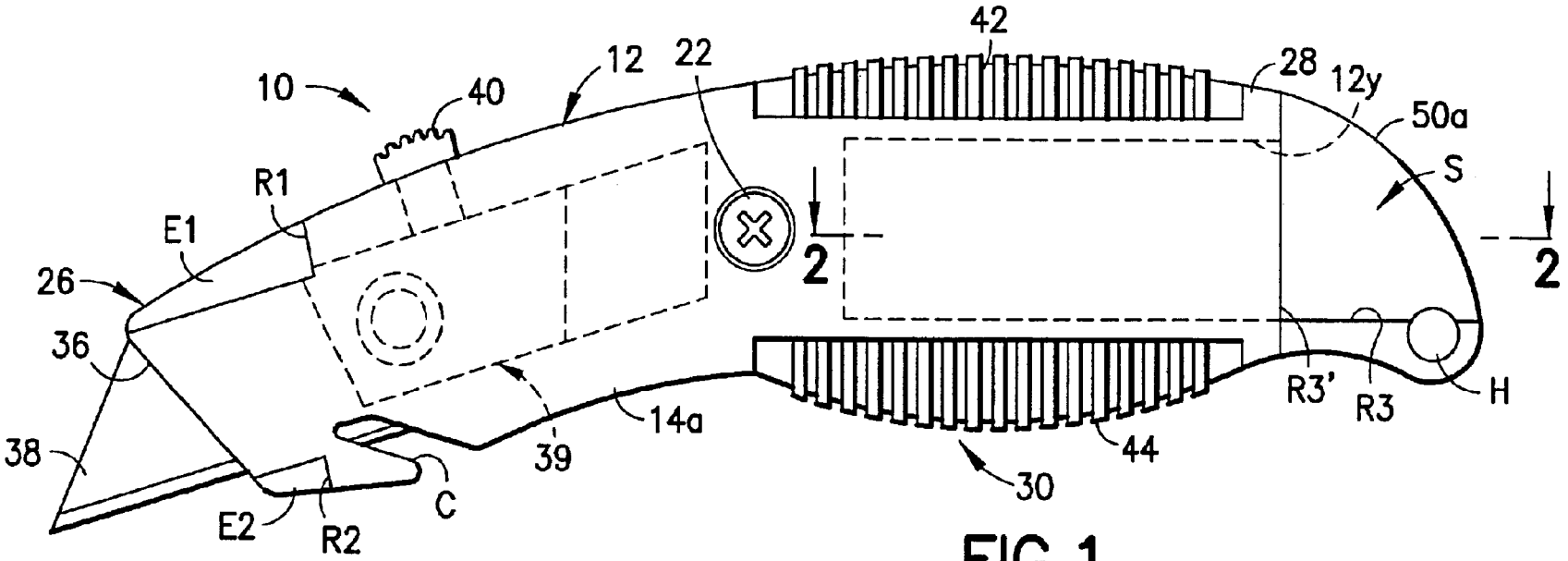
FIG. 1 a side elevational view of an adjustable safety utility knife with an easily removable blade holder in accordance with the present invention.

Referring now to the Figures, in which identical or similar parts are designated by the same reference numerals throughout, and first referring to FIG. 1, an adjustable safety utility knife in accordance with the present invention is generally designated by the reference numeral 10.

The utility knife 10 includes an elongated ergonomically shaped handle 12 formed of two elongate shell members 14*a*, 14*b*, each having a peripheral edge 16*a*, 16*b*, respectively, and outer generally convex surfaces 18*a*, 18*b* and inner generally concave surfaces 20*a*, 20*b*, respectively. A suitable fastener, such as a transverse screw 22 (FIG. 1) is provided for fastening the shell members 14*a*, 14*b* to each other at the peripheral edges 16*a*, 16*b* along a vertical parting plane P-(FIG. 2) to form an elongated internal cavity or compartment 24. The handle 12 defines a front end 26, a back end 28 and an intermediate portion 30 suitable to be gripped by the user, and also defines top and bottom surfaces 32, 34, respectively. Top and bottom surfaces extend along the top and bottom surfaces of the shell members 14*a*, 14*b* along the peripheral edges. The handle 12 has a conventional slot-like aperture 36 (FIG. 1) and a front end 26 substantially aligned with the parting plane P and dimensioned for passage of a flat cutting blade 38 therethrough. A guide member, in the form of a cartridge 39, is provided within the cavity 24, in the front end 26 for guiding the cutting blade 38 between a first portion for safely storing the blade 38 inside of the cavity and a second position for selectively extending the blade beyond the aperture 36 for exposing a portion thereof, as shown in FIG. 1. The carriage or the blade is shown in phantom outline, the details thereof being more fully described in co-pending U.S. patent application Ser. No. 09/374523 which has been assigned to the same assignee of the present invention.

A manually operated button 40, of the type frequently used in utility knives of this type, is arranged on the top surface 32 and coupled to the guide element for selectively moving the blade 38 between the first and second positions.

Slip resistant elements 42, 44 are provided and arranged on the top and bottom surfaces 32, 34, respectfully. The elements generally conform to the outer convex surfaces 18*a*, 18*b*, and enhance the gripping action of the handle 12 and minimize slippage of the handle during use.

As the shell members are fastened together by means of a single fastener in the nature of a screw 22, the shell members are preferably provided with one or more cutouts or recesses in one of the shell members and extensions in the other shell member that mates therewith. In the embodiment illustrated in FIG. 1, the shell member 14*a* is provided at the front end 26 thereof with upper and lower recesses or cutouts R1, R2 that receive transverse extensions E1, E2 that are integrally formed on the opposing shell member 14*b*. It will be appreciated that when the recesses and extensions mate and interlock as shown, it will be clear that the shell members will not have a tendency to pivot or shift in relation to each other.

The blade guide or carriage 39 is mounted on suitable guide surfaces (not shown) for guiding the cutting blade between a first retracted position for storing the blade fully inside the cavity and a second position for selectively extending the blade beyond the aperture 36 to expose at least a portion thereof, as shown in FIG. 1.

The manually operated button 40 is arranged on the top surface 32 and coupled to the guide element 39 for selectively moving the blade between the first and second positons.

Figure 2A:
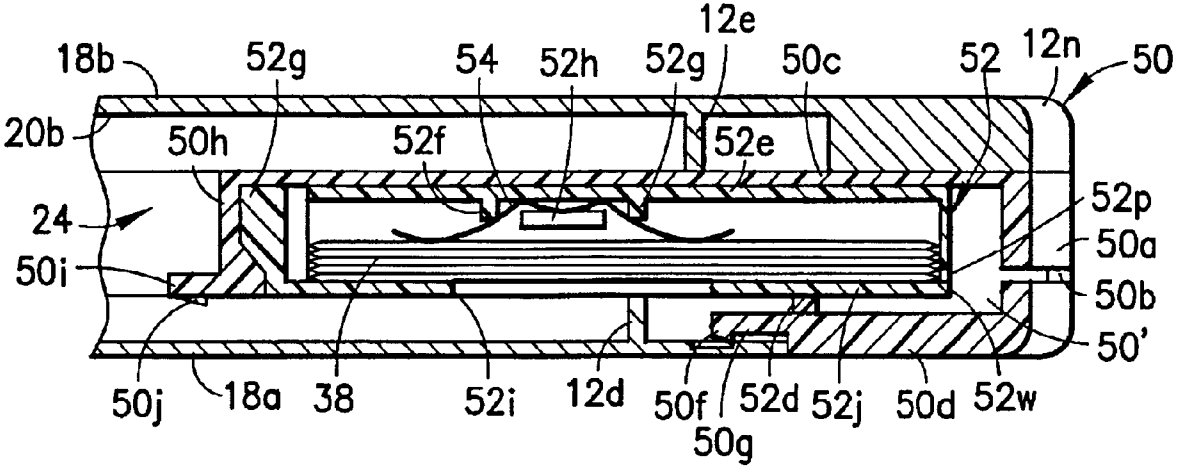
FIG. 2A is a cross-sectional view of the utility knife shown in FIG. 1, taken along line 2—2, shown with the blade holder and cartridge therein in the fully retracted position.
Figure 2B:
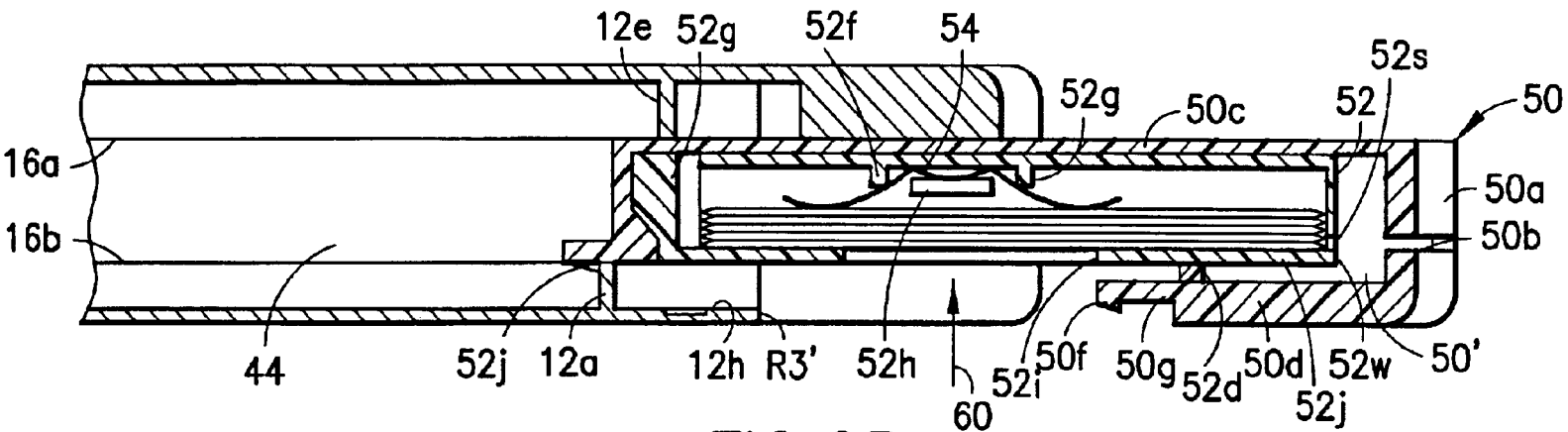
FIG. 2B is similar to FIG. 2A except that the blade holder is shown in its fully extended position in condition for removal of a blade from the cartridge.

Referring to FIGS. 1, 2A and 2B, the handle 12 has a rear opening at the back end 28 for providing access to the elongated internal cavity 24. The opening is formed by a recess R3 which removes the rear part of the shell 18*a* up to the vertical edge R3' (FIG. 2B), retaining an arcuate or curved surface 12*n* which forms part of the back end of the shell member 18*b*, as best shown in FIGS. 2A and 2B. A carrier frame is generally designated by the reference numeral 50, which has a blade receiving compartment 50' and dimensioned to be removably receivable from within the cavity 24 through the rear opening between a retracted position as shown in FIG. 2A, in which the carrier frame 50 is fully stored within the internal cavity 24 of the handle and an extended position shown in FIG. 2B in which the carrier frame 50 is at least partially moved exteriorly of the back end to provide access to the cartridge receiving compartment. A blade cartridge 52 is provided which is slidably receivable within the carrier frame for storing a plurality of flat cutting blades 38 receivable within the blade cartridge receiving compartment 50', each of the blades being individually fully removable through a rear slot formed by a carrier frame slot 50*b* and cartridge slot 52 that are aligned with each other as best shown in FIGS. 2A and 2B.

The carrier frame 50 includes an arcuate portion having a curved surface 50*a* that generally conforms with the arcuate curved surface 12*n* (FIG. 2A) of the handle so that when the carrier frame is within the cavity 24 the exterior surfaces 50*a*, 12*n* of the carrier frame and the back of the handle blend to provide a unitary shape or appearance. A generally vertical slot 50*b* is provided in the arcuate surface or wall 50*a*.

The carrier frame has a lateral wall 50*c*, most proximate to the shell member 18*b*, and an opposing wall 50*d* which is substantially in line or co-planar with the wall of the shell member 18*a*, an outwardly directed tapered hook being formed at the end of a rearwardly projecting tab 50*g*.

At the end of the carrier frame 50 remote from the curved surface 50*a* there is provided a rear wall 50*h* which includes a vertical tab 50*i* on the exterior surface of which there is provided a tapered projection 50*j*. The projection 50*j* becomes operative when the carrier is moved from its retracted to its extended positions shown in FIG. 2B, the projection 50*j* serving as a limit stop by engaging a positioning rib 12*d* formed on the shell member 18*a*. A similar vertical projection 12*e* is provided on the inside surface 20*b* of the shell member 18*b* to serve as a positioning member for maintaining the lateral position of the carrier frame within the cavity 24. Thus, in its extended position the projection 50*j* engages the vertical rib 12*d*,while movement of the carrier frame interiorly to its fully retracted position causes the tapered hook 50*f* to engage a tapered projection 12*h* formed on the inner surface 20*a* of the shell member 18*a*, as best illustrated in FIG. 2A.

Slits 50*e* provided above and below the wall extension 50*g* render the wall 50*d* more flexible in the intermediate region thereof, facilitating the depression or deflection of the wall extension 50*g* when the carrier frame needs to be removed. By pressing on the wall 50*d*, substantially at the center thereof, the tapered hook 50*f* clears the tapered projection 12*h* to allow the carrier frame to slide out from within the housing of the handle, as shown in FIG. 2B.

Figure 3:
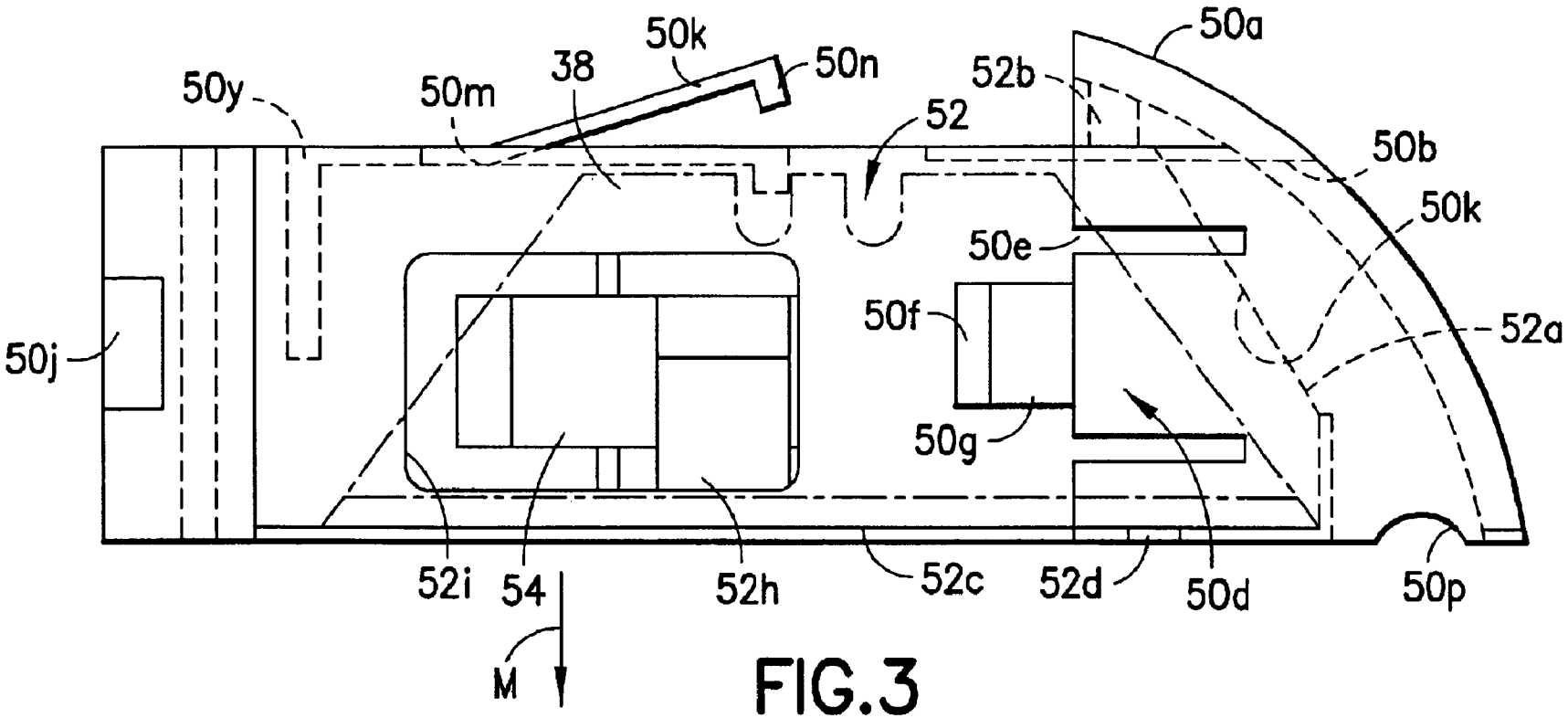
FIG. 3 is an enlarged side elevational view of the blade holder shown in FIGS. 2A and 2B, showing a cartridge positioned within the blade holder when there are no blades within the cartridge.

A cartridge 52 that contains the cutting blades is generally designated by the reference numeral 52. In order to substantially fix the position of the cartridge 52 within the carrier frame 50 during normal operation, a number of features are provided that secure the cartridge against movements relative to the carrier frame. Thus, inclined edges 52*a* on the cartridge are received within corresponding inclined indentations or recesses 50*k* within the inside surface 20*b* of the shell member 18*b*. Additionally, an upwardly extending limit tab 52*b* is provided on the cartridge which abuts against the inner surface of the upper end of the inclined surface 50*a* of the carrier frame, as shown in FIG. 3. Also, formed on the bottom wall 52*c* of the cartridge there is advantageously provided a lateral limit tab 52*d* which abuts against the inner surface of the wall 50*d*, to prevent undesired lateral movements and to ensure alignment of the slot 52*s* in the rear wall 52*w* with the slot 50*b* in the carrier frame. In order to further ensure the positional stability of the unit during normal use, the cartridge is preferably with a rear wall 52*q* that generally conforms to the interior surface or shape of the rear wall 50*h* of the carrier frame member, which permits the two aforementioned components to be separated only by a relative sliding downward movement of the cartridge in relation to the carrier frame, as best shown and suggested by the arrow M in FIG. 3. An additional positioning wall 50*y* is advantageously provided that extends downwardly as shown in FIG. 3 to capture the wall 52*q* of the cartridge. With this construction, therefore, the cartridge is fully captured within the carrier frame and shares all linear, sliding movements therewith as the carrier frame is extended and retracted into the handle.

Mounted on the inside surface of the wall 52*e* of the cartridge 52, substantially centrally of the longitudinal length of the cartridge, there is provided a retaining standoff 52*h* to each lateral side of which there are provided vertical ribs 52*f*, 52*g* as shown in FIGS. 2A and 2B. A leaf spring 54 has a central portion thereof captured between the retaining standoff 52*h* and the wall 52*e* and is prevented from shifting laterally by the vertical ribs 52*f*, 52*g*. The leaf spring 54 has two lateral spring members or wings which are bent forwardly towards an opening 52*i* in the wall 52*j* of the cartridge. It will be clear that insertion of cutting blades 38 within the cartridge, as shown, will be urged or biased towards the opening 52*i* by means of the leaf spring, so that if there are any blades within the cartridge one of these blades will be in abutment against the wall 52*j* and accessible for finger contact through the opening 52*i*.

While the longitudinal length of the inner cartridge is substantially equal to the maximum dimension of the blades, the blades are prevented from shifting within the cartridge by means of a movable tab 50*k* provided at the top of the cartridge which is hinged, such as by a plastic hinge 50*m* at one end and having a downwardly directed right angle finger 50*n* dimensioned to be received within a conventional open notch at the upper edge of the cutting blade. When the assembly of the carrier frame and the cartridge are inserted into the handle, the tab 50*k* is automatically forced downwardly by the inside surface 12*y* (FIG. 1) of the shell members, causing the finger 50*n* to be moved into one of the notches of the blade(s) thereby maintaining all of the blades in alignment within the cartridge. When a blade is to be removed from the cartridge and the carrier frame is withdrawn or brought to its extended position shown in FIG. 2B, the movable tab 50*k* clears the surface 12*y* and the tab is resiliently lifted to the position shown in FIG. 3, clearing the notches and allowing a blade to be removed from the cartridge. If the cartridge is not made from a plastic material to allow use of a plastic hinge, the tab 50*k* may also be mounted using a standard hinge and a suitable spring may be used to urge the tab to the position shown in FIG. 3.

In use, when a blade needs to be extracted or removed from the cartridge, the wall 50*d* is initially manually pressed inwardly, allowing the tapered hook 50*f* to clear the tapered projection 12*h*. This permits the carrier frame to be moved outwardly until the tapered projection 50*j* comes into abutment with the positioning rib 12*d*. In this position, the opening or window 52*i*, concealed when in the retracted position shown in FIG. 2A, becomes exposed and a user may, using his or her finger, contact the outermost blade that abuts the wall 52*j* of the cartridge and slide the blade rearwardly through the aligned slots 52*s* and 50*b* to extract the blade. When removal is completed, the carrier frame may be slid back into the housing of the handle 12 to the position shown in FIG. 2A, at which point the carrier frame becomes locked withing the handle by means of the tapered hook 50*f* and the tapered projection 12*h*.

It will be noted from the foregoing that the removable blade holder in accordance with the invention ensures that the blades are always securely stored within the holder and within the cartridge, the possibility of blades inadvertently falling out of the unit being extremely remote because of the dual encasement construction. Also, the removal of blades is easy and convenient. Because there is a separate blade cartridge 52, individual blades need not be handled when the blades are inserted into the unit for future use. The cartridge 52 is, preferably, supplied to the user as a pre-packaged unit so that the cartridge can simply be inserted and snapped into place without ever touching the blades. Inadvertent opening of the blade compartment is, therefore, virtually impossible. The resulting design is, therefore, extremely safe to use and virtually child-proof As indicated, even is the carrier frame is withdrawn, this would not expose the dangerous cutting edges of the blades. The additional step of manually sliding a blade, through the opening or window 52*i*, would need to be taken to remove the blade from the cartridge.

The invention has been shown and described by way of a presently preferred embodiment, and many variations and modifications may be made therein without departing from the spirit of the invention. The invention, therefore, is not to be limited to any specified form or embodiment, except insofar as such limitations are expressly set forth in the claims.

What we claim:

1. An adjustable safety utility knife comprising an elongated ergonomically shaped handle formed of two elongate shell members each having a peripheral edge; fastening means for fastening said shell members at said peripheral edges along a vertical parting plane to form an elongated internal cavity, said handle defining a front end, a back end and an intermediate portion suitable for being gripped by a user and also defining top and bottom surfaces extending along opposite sides of said shell members along said peripheral edges, said handle having a slot-like aperture at said front end substantially aligned with said parting plane and dimensioned for passage of a flat cutting blade therethrough; guide means within said elongated cavity for guiding the cutting blade between a first position for safely storing the blade fully inside said cavity and a second position for selectively extending the blade beyond said aperture to expose at least a portion thereof; a manually operated button arranged on said top surface and coupled to said guide means for selectively moving the blade between said first and second positions, said handle having a rear opening at same back end for providing access to said elongated internal cavity; a carrier frame having a blade cartridge receiving compartment and dimensioned to be slideably removably receivable within said cavity through said rear opening for movements along the longitudinal direction of said handle between a retracted position in which said carrier frame is fully stored within said internal cavity of said handle end and an extended position in which said carrier frame is at least partially moved exteriorly of said back end to provide access of said cartridge receiving compartment; and a blade cartridge for storing a plurality of flat cutting blades receivable within said blade cartridge receiving compartment, dimensioned for passage, from said blade cartridge, of a flat cutting blade therethrough.

2. An adjustable safety utility knife comprising an elongated ergonomically shaped handle formed of two elongate shell members each having a peripheral edge and an outer generally convex surface and an inner generally concave surface; fastening means for fastening said shell members at said peripheral edges along a vertical parting plane to form an elongated internal cavity, said handle defining a front end, a back end and an intermediate portion suitable for being gripped by a user and also defining top and bottom surfaces extending along opposite sides of said shell members along said peripheral edges, said handle having a slot-like aperture at said front end substantially aligned with said parting plane and dimensioned for passage of a flat cutting blade therethrough; guide means within said elongated cavity for guiding the cutting blade between a first position for safely storing the blade fully inside said cavity and a second position for selectively extending the blade beyond said aperture to expose at least a portion thereof; a manually operated button arranged on said top surface and coupled to said guide means for selectively moving the blade between said first and second positions, said handle having a rear opening at said back end for providing access to said elongated internal cavity; a carrier frame having a blade cartridge receiving compartment and dimensioned to be removably receivable within said cavity through said rear opening between a retracted position in which said carrier frame is at least partially moved exteriorly of said back end to provide access of said cartridge receiving compartment; and a blade cartridge, said carrier frame having a rear wall that generally conforms with the configuration of said outer convex surface of said handle, and said rear wall having a rear slot-like aperture generally parallel to said parting plane and dimensioned for passage of a flat cutting blade therethrough.

3. An adjustable safety utility knife as defined in claim 2, wherein said cartridge has a width suitable for storing a plurality of flat cutting blades, said carrier frame having parallel lateral walls spaced from each other along a direction transverse to said cutting plane; and biasing means in contact with one of said lateral walls for urging any flat cutting blades against the other of said lateral walls.

4. An adjustable safety utility knife as defined in claim 2, wherein said rear aperture is generally aligned with the position of the flat cutting blade in contact with said other of said lateral walls, said cartridge being provided with a blade-passing opening facing said rear wall, whereby a flat cutting blade can be moved out of said cartridge and through said rear aperture for removal and insertion through said front aperture for use.

5. An adjustable safety utility knife as defined in claim 4, wherein said other of said lateral walls is provided with at least one opening to expose at least a portion of the surface of a flat cutting blade in contact with said other of said lateral walls, whereby a user can apply a manual force on the cutting blade and urge the cutting blade to slide out of said cartridge and said carrier frame.

6. An adjustable safety utility knife as defined in claim 5, wherein said at least one opening comprises an elongate opening extending along a direction substantially parallel to the longitudinal direction of said handle.

7. An adjustable safety utility knife as defined in claim 1, further comprising locking means for normally locking said carrier frame in said retracted position within said handle.

8. An adjustable safety utility knife as defined in claim 7, wherein said locking means comprises a fixed stop on at least one of said elongate shell members and a resiliently biased snap tab that engages said fixed stop when said carrier frame is moved to its fully retracted position.

9. An adjustable safety utility knife as defined in claim 8, wherein said snap tab is mounted on a manually deflectable portion of said carrier frame that can be manually depressed to cause said snap tab to clear said fixed stop to enable said carrier frame to be moved rearwardly in relation to said handle.

10. An adjustable safety utility knife as defined in claim 9, wherein one of said shell members includes a cutout region at said back end forming an edge generally transverse to said longitudinal direction spaced from said back end, said fixed stop being provided on said one of said shell members, said carrier frame having a wall portion that substantially covers said cutout region and includes a resiliently mounted snap supporting portion for supporting said snap tab to normally provide an interference fit with said fixed stop and to cause said snap tab to clear said fixed stop when said snap supporting portion is manually pressed inwardly in the direction of the other of said shell members.

11. An adjustable safety utility knife as defined in claim 1, wherein said shell members are provided with carrier frame guide means for slidingly guiding said carrier frame between said retracted and extended positions.

12. An adjustable safety utility knife as defined in claim 1, wherein said carrier frame is totally removable from said handle.

13. An adjustable safety utility knife as defined in claim 1, wherein said shell members are made from a metallic material and said carrier frame is made of a plastic material.

* * * * *